US010073389B1

(12) United States Patent
Ajima

(10) Patent No.: US 10,073,389 B1
(45) Date of Patent: Sep. 11, 2018

(54) IMAGE FORMING METHOD USING LOW MELTING POINT TONER

(71) Applicants: KABUSHIKI KAISHA TOSHIBA, Tokyo (JP); TOSHIBA TEC KABUSHIKI KAISHA, Tokyo (JP)

(72) Inventor: Hisanobu Ajima, Yokohama Kanagawa (JP)

(73) Assignees: Kabushiki Kaisha Toshiba, Tokyo (JP); Toshiba TEC Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/717,618

(22) Filed: Sep. 27, 2017

(30) Foreign Application Priority Data

Mar. 10, 2017 (JP) ..... 2017-046511

(51) Int. Cl.
*G03G 15/20* (2006.01)

(52) U.S. Cl.
CPC ..... *G03G 15/205* (2013.01); *G03G 15/2078* (2013.01)

(58) Field of Classification Search
CPC ..... G03G 15/205; G03G 15/2078
See application file for complete search history.

(56) References Cited

U.S. PATENT DOCUMENTS 9,857,751 B2 * 1/2018 Itoh ..... G03G 15/6585
2011/0262159 A1 * 10/2011 Takeuchi ..... G03G 15/2078 399/44
2014/0023389 A1 * 1/2014 Ono ..... G03G 15/2017 399/69
2015/0301464 A1 * 10/2015 Peter ..... G03G 9/08711 430/109.3

FOREIGN PATENT DOCUMENTS

JP 2004212543 A 7/2004

* cited by examiner

*Primary Examiner* — Rodney Bonnette
(74) *Attorney, Agent, or Firm* — Patterson & Sheridan, LLP

(57) ABSTRACT

A method for forming a fixed toner image includes maintaining a fixing device temperature at a standby temperature, and after wake-up from the standby state, forming an unfixed toner image on a sheet using a low melting point toner. The difference between temperatures that cause a viscosity of the toner in first and second conditions to be 1.0 ($10^5$ Pa·s) is within a range of 30° C. to 60° C., the toner in the first condition not having been maintained in a 160° C. environment for 24 hours and the toner in the second condition having been maintained in a 160° C. environment for 24 hours. The method further comprises increasing the fixing device temperature to a fixing temperature of the toner, which is higher than the standby temperature, and after the fixing device temperature has reached the fixing temperature, passing the sheet with the unfixed toner image through the fixing device.

20 Claims, 12 Drawing Sheets

FIG. 9

| | Toner | FIXING TEMPERATURE – TEMPERATURE OF FIXING DEVICE DURING NO-PRINTING | RECOVERY TIME | HEAT ROLLER SCRATCH | EVALUATION |
|---|---|---|---|---|---|
| EXAMPLE 1 | Toner A1 | 30°C | B | B | B |
| EXAMPLE 2 | Toner A1 | 60°C | B | A | B |
| EXAMPLE 3 | Toner A1 | 10°C | A | B | B |
| EXAMPLE 4 | Toner B1 | 30°C | B | A | B |
| EXAMPLE 5 | Toner C1 | 30°C | B | A | B |
| COPMPARISON EXAMPLE 1 | Toner A1 | 0°C | A | C | C |
| COPMPARISON EXAMPLE 2 | Toner A1 | 8°C | A | C | C |
| COPMPARISON EXAMPLE 3 | Toner A1 | 62°C | C | A | C |
| COPMPARISON EXAMPLE 4 | Toner A1 | 80°C | C | A | C |
| COPMPARISON EXAMPLE 5 | Toner D1 | 30°C | B | C | C |

| WARMING UP TIME DIFFERENCE (t-E)-(t-D) | HEAT ROLLER CORRECTION TEMPERATURE |
|---|---|
| 0 | 0 |
| 1 | -10 |
| 2 | -20 |
| 3 | -30 |
| 4 | -40 |
| 5 | -50 |

| | WARMING UP TIME DIFFERENCE (t-E)-(t-D) | HEAT ROLLER CORRECTION TEMPERATURE | HEAT ROLLER SCRATCH | FINAL DETERMINATION |
|---|---|---|---|---|
| EXAMPLE 4 | 1 | −10 | B | B |
| EXAMPLE 5 | 2 | −20 | B | B |

IMAGE FORMING METHOD USING LOW MELTING POINT TONER

CROSS-REFERENCE TO RELATED APPLICATION

This application is based upon and claims the benefit of priority from Japanese Patent Application No. 2017-046511, filed Mar. 10, 2017, the entire contents of which are incorporated herein by reference.

FIELD

Embodiments described herein relate generally to an image forming method, in particular an image forming method using low melting point toner.

BACKGROUND

In the related art, low melting point toner, i.e., toner having a melting point temperature that is lower than that of a conventional toner, containing crystalline polyester has a feature of quickly melting with heat. By using the low melting point toner, it is possible to fix a toner image on a sheet at a lower temperature of a fixing device.

In the fixing device, a contact-type thermistor (hereinafter, referred to as "thermistor") is often used in order to control the temperature of the fixing device. The thermistor contacts a heat roller of the fixing device to measure temperature. For that reason, toner remaining on the heat roller after a fixing process may be attached to the thermistor. When conventional toner is used, some of the conventional toner that is attached to the thermistor during an image forming process is hardened and naturally detached from the thermistor. Alternately, the conventional toner attached to the thermistor is heated again and softened when subsequent fixing is performed. However, when the low melting point toner is used for image forming, it is found that a scratch is formed on a surface of the fixing roller.

DESCRIPTION OF THE DRAWINGS

FIG. 9 illustrates a test result obtained by performing a sheet passing test using the image forming apparatus.

DETAILED DESCRIPTION

An embodiment provides an image forming apparatus and an image forming method capable of forming an image with less image degradation.

In general, according to an embodiment, there is provided a method for forming a fixed toner image on a sheet using an image forming apparatus. The method comprises maintaining a temperature of a fixing device of the image forming apparatus at a standby temperature during a standby state, and after wake-up from the standby state, forming an unfixed toner image on a sheet using a low melting point toner. The difference between a temperature to cause a viscosity of the toner in a first condition to be 1.0 ($10^5$ Pa·s) and a temperature to cause the viscosity of the toner in a second condition to be 1.0 ($10^5$ Pa·s) is within a range of 30° C. to 60° C., the toner in the first condition not having been maintained in a 160° C. environment for 24 hours and the toner in the second condition having been maintained in a 160° C. environment for 24 hours. The method further comprises increasing the temperature of the fixing device to a fixing temperature of the toner, which is higher than the standby temperature by 10° C. to 60° C., and after the temperature of the fixing device has reached the fixing temperature, passing the sheet with the unfixed toner image through the fixing device such that the unfixed toner image is fixed onto the sheet.

Hereinafter, an image forming apparatus and an image forming method of an embodiment will be described with reference to the drawings.

First Embodiment

First, a mechanism that scratches are formed on a fixing device when printing is performed by a toner using crystalline polyester will be described. The inventors found that toner containing crystalline polyester attached to a thermistor is heated for a long time in a range around a fixing temperature by the fixing device, and thereby thermal characteristics of the toner are changed. In a normal printing operation (state in which fixing of toner is being performed), the toner on the thermistor is detached therefrom even if the toner is attached to the thermistor. On the other hand, when a state where the fixing device stands by at a fixing temperature is long without performing the printing operation, the toner deposited on the thermistor is heated by the fixing device for a long time. In this case, the toner deposited on the thermistor is irreversibly hardened (i.e., increases viscosity). The hardened toner causes the scratches on a heat roller, and further when the toner sticks to the scratch, the toner may cause image degradations such as image streaks.

Figure 1:
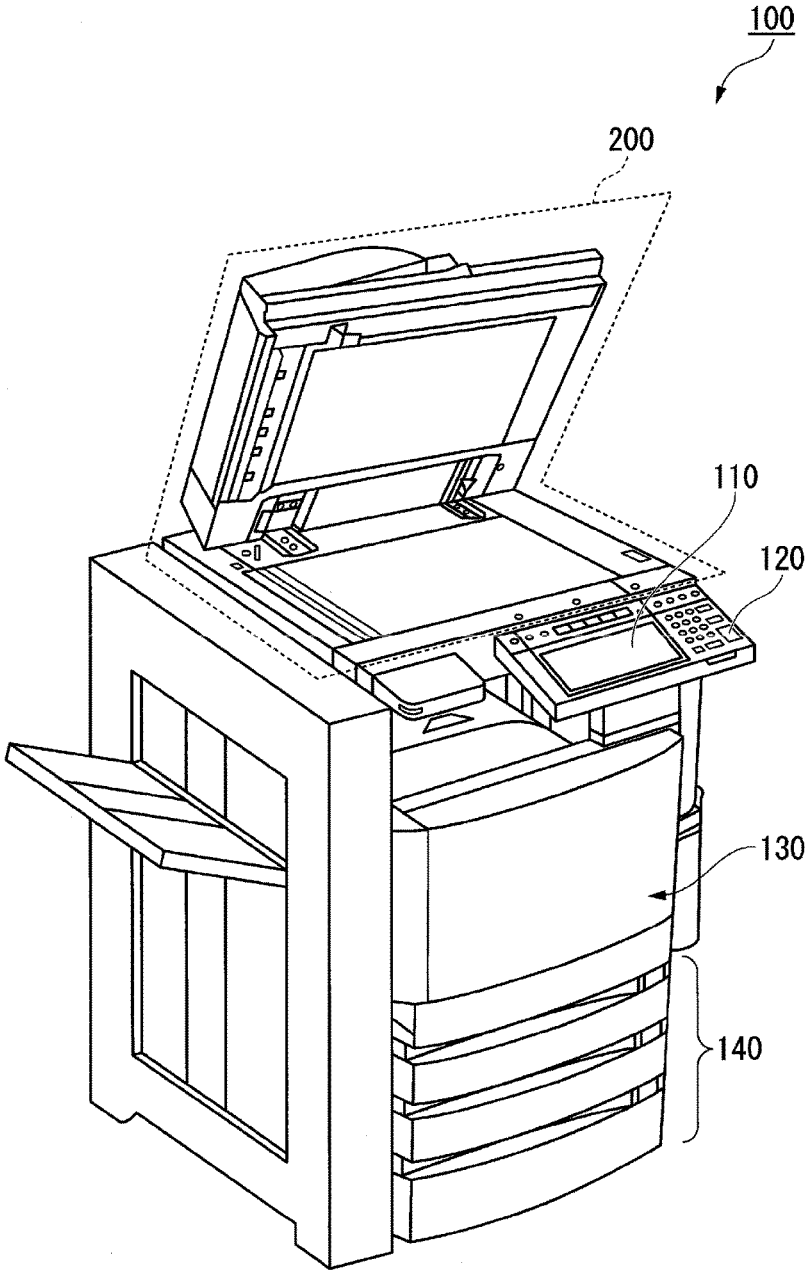
FIG. 1 is an external view of an image forming apparatus according to a first embodiment.

FIG. 1 is an external view of an image forming apparatus 100 according to a first embodiment. For example, the image forming apparatus 100 is a multifunction machine. The image forming apparatus 100 includes a display 110, a control panel 120, a printer unit 130, a sheet accommodating unit 140, and an image reading unit 200. The printer unit 130 of the image forming apparatus 100 may be a device for fixing a toner image or may be an inkjet-type device.

The image forming apparatus 100 forms an image on a sheet using developer such as the toner. For example, the sheet is paper or label paper. The sheet may be anything on which an image can be formed on the surface thereof by the image forming apparatus 100. There is a low melting point toner of which viscosity increases by exposing the toner in a predetermined environment. For example, the predetermined environment is an environment that is maintained in a high temperature for a long time, or the like, as in the vicinity of the heat roller. For example, the long time is 24 hours. For example, the high temperature is 160° C., which is equal to or near the fixing temperature. For example, the low melting point toner is a toner in which crystalline PES is used.

The display 110 is an image display device such as a liquid crystal display, and an organic electroluminescence (EL) display. The display 110 displays various types of information relating to the image forming apparatus 100.

The control panel 120 includes a plurality of buttons. The control panel 120 receives an operation of a user. The control panel 120 outputs a signal in accordance with the operation performed by the user with respect to a control unit of the image forming apparatus 100. The display 110 and the control panel 120 may be configured as an integrated touch panel.

The printer unit 130 forms an image on a sheet based on image information generated by the image reading unit 200 or image information received through a communication path. For example, the printer unit 130 forms the image by the following processes. The image forming unit of the printer unit 130 forms an electrostatic latent image on a photoconductive drum based on the image information. The image forming unit of the printer unit 130 forms a visible image by forming developer on the electrostatic latent image. An example of the developer includes toner. A transfer unit of the printer unit 130 transfers the visible image onto the sheet. A fixing unit of the printer unit 130 generates heat and performs pressing with respect to the sheet, and thereby fixes the visible image on the sheet. The sheet on which the image is formed may be a sheet accommodated in the sheet accommodating unit 140 or a sheet manually supplied.

The sheet accommodating unit 140 accommodates sheets to be used for image formation in the printer unit 130.

The image reading unit 200 generates image information of a read target based on brightness and darkness of light reflected by an original. The image reading unit 200 stores the read image information. The stored image information may be transmitted to an information processing apparatus through a network. The image information may be visualized as an image on the sheet by the printer unit 130.

Figure 2:
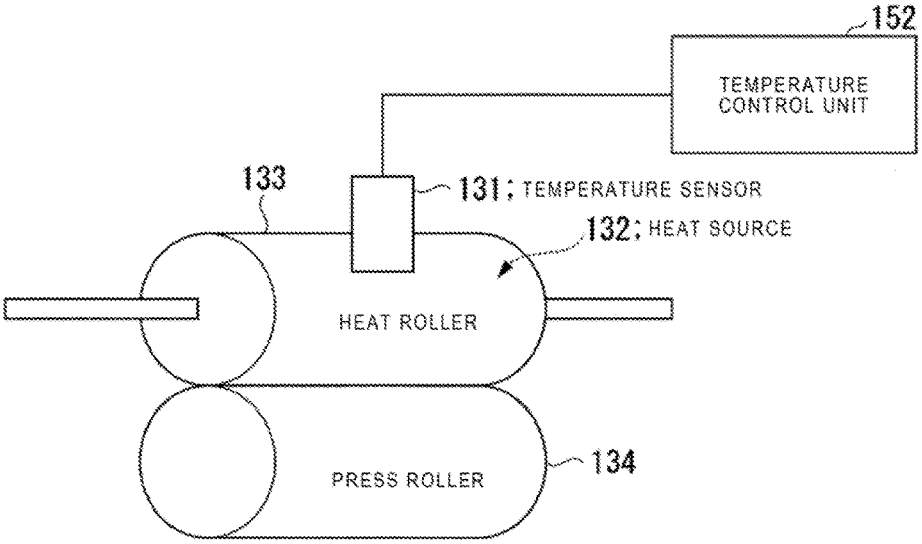
FIG. 2 illustrates a configuration example of a fixing device included in the image forming apparatus.

FIG. 2 illustrates a configuration example of a fixing device 130*a* included in the image forming apparatus 100 according to the first embodiment. The fixing device 130*a* is included in the printer unit 130. The fixing device 130*a* includes a temperature control unit 152, a temperature sensor 131, a heat source 132, a heat roller 133, and a press roller 134. The fixing device 130*a* causes the toner attached on the sheet to be melted. The fixing device 130*a* applies pressure to the melted toner and attaches the toner to the sheet. The temperature control unit 152 is included in a control unit 150 (see FIG. 3).

The temperature control unit 152 controls a temperature of the heat roller 133 to be within a predetermined temperature range. The temperature control unit 152 determines whether an electric power supply amount to the heat source 132 increases or decreases based on temperature information received from the temperature sensor 131. Based on a determined result, the temperature control unit 152 determines the amount of electric power to be supplied from the heat source 132. The predetermined temperature range is a range including a target fixing temperature when fixing by the fixing device 130*a* is carried out and a standby temperature range during a standby time during which the printer unit 130 is not performing the image formation. In the present embodiment, the target fixing temperature is 160° C.

The temperature sensor 131 measures the temperature of the heat roller 133. For example, the temperature sensor 131 is a contact type thermistor. The temperature sensor 131 measures a surface temperature of a contact surface in contact with the heat roller 133. The temperature sensor 131 outputs the measured temperature to the temperature control unit 152.

The heat source 132 heats the heat roller 133 by generating heat. For example, the heat source 132 is a halogen lamp. The heat source 132 changes generated heat quantity based on a temperature determined by the temperature control unit 152. The heat source 132 is disposed inside the heat roller 133.

The heat roller 133 causes melting of the toner attached to the sheet passing between the heat roller 133 and the press roller 134 by the surface temperature thereof. The heat roller 133 is heated by the heat source 132. When the image formation is carried out, the surface temperature of the heat roller 133 is maintained at the fixing temperature. During the standby state, the surface temperature of the heat roller 133 is maintained at a temperature equal to or lower than the fixing temperature. Rotation of the heat roller 133 causes conveyance of the sheet.

The press roller 134 applies pressure to the sheet passing between the heat roller 133 and the press roller 134. The press roller 134 applies the pressure on the sheet, and thereby the toner melted by the heat roller 133 is fixed onto the sheet. Rotation of the press roller 134 causes conveyance of the sheet.

Figure 3:
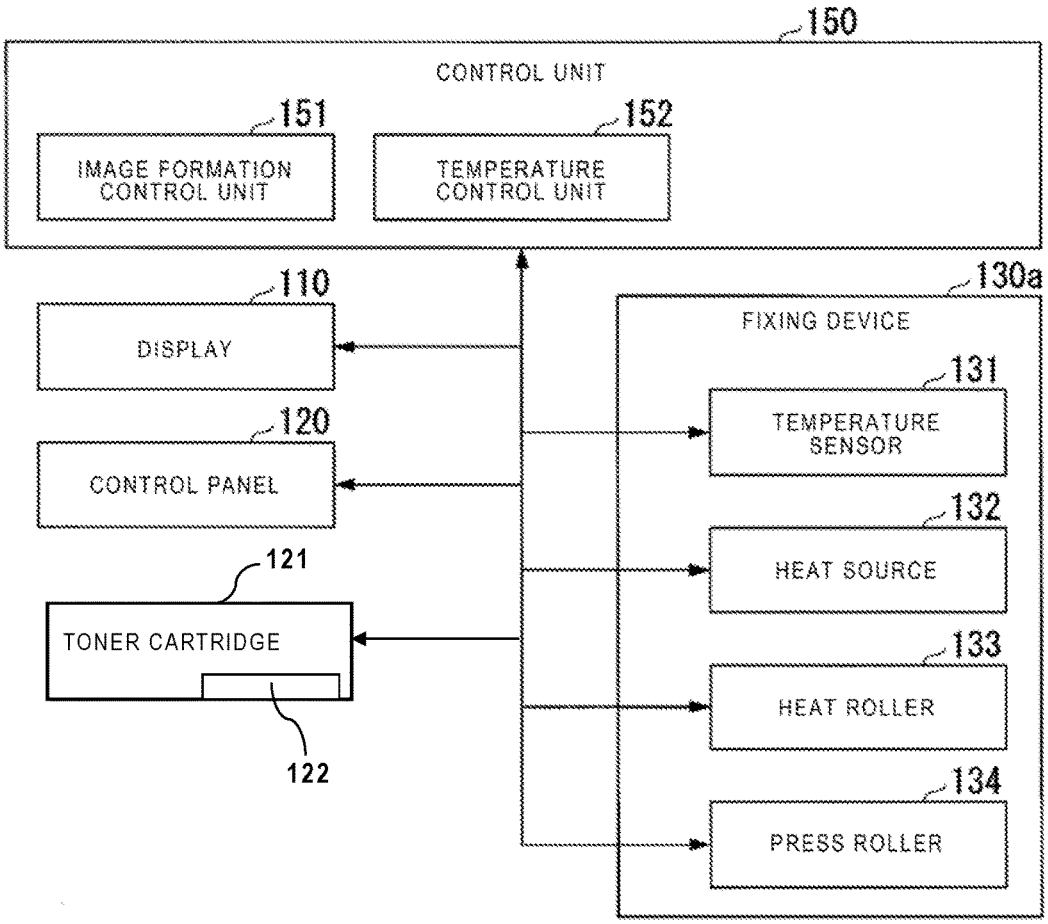
FIG. 3 is a block diagram illustrating functional units for performing a fixing process in the image forming apparatus.

FIG. 3 is a block diagram illustrating functional units for performing a fixing process in the image forming apparatus 100 according to the first embodiment. The image forming apparatus 100 includes the display 110, the control panel 120, the fixing device 130*a*, and the control unit 150. The fixing device 130*a* includes the temperature sensor 131, the heat source 132, the heat roller 133, and the press roller 134. Hereinafter, the description of the functions already described with reference to FIG. 1 and FIG. 2 will be omitted.

Figure 4:
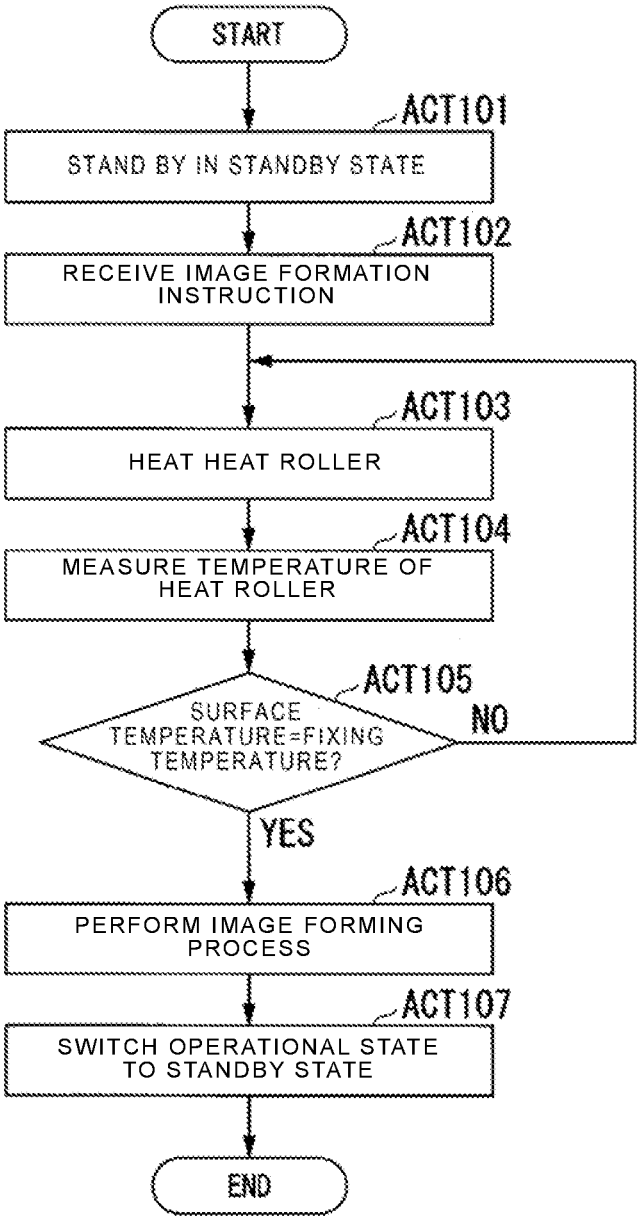
FIG. 4 is a flowchart illustrating a flow of the fixing process carried out by the image forming apparatus.

The control unit 150 controls operations of each unit of the image forming apparatus 100. For example, the control unit 150 is a device including a central processing unit (CPU) and a random access memory (RAM). The control unit 150 executes an image forming program, and thereby functions as an image formation control unit 151 and the temperature control unit 152. The image formation control unit 151 controls the printer unit 130 to perform an image forming process based on an instruction received from the control panel 120. Toner cartridge 201 storing toner therein is mounted in the image forming apparatus 100. The toner cartridge 121 has a memory 122 that stores fixing temperature and standby temperature of the fixing device 132. The fixing temperature and the standby temperature are set in accordance with the toner property. The control unit 150 reads the memory 122 and controls the temperature of the heat roller 133 in accordance with the fixing temperature and the standby temperature stored in the memory 122. FIG. 4 is a flowchart illustrating a flow of the fixing process carried out by the image forming apparatus 100 according to the first embodiment. The image forming apparatus 100 stands by in a standby state (Act 101). The control panel 120 of the image forming apparatus 100 receives an image forming instruction from a user (Act 102). The temperature control unit 152 heats the heat roller 133 so as to cause the heat source 132 to generate heat (Act 103). The temperature sensor 131 measures the surface temperature of the heat roller 133 (Act 104). The temperature control unit 152 determines whether or not the measured surface temperature is in a fixing temperature range including the fixing temperature (Act 105). When the surface temperature is in the fixing temperature range (Act 105: NO), the process transitions to Act 103. When the surface temperature is not within the fixing temperature range (Act 105: YES), the printer unit 130 performs the image forming process (Act 106). When the image forming process is finished, the image forming apparatus 100 transitions to the standby state (Act 107).

Here, the toner will be described in detail. Toner A1, toner B1, and toner C1 and toner D1 are prepared by the following method. The toner A2, toner B2, toner C2 and toner D2 are obtained by leaving the toner A1, toner B1, toner C1, and toner D1 for 24 hours at 160° C., respectively.

Toner A1;

Polyester resin A having softening point 118° C. (which is an example of a binder) 80 parts by weight
Crystalline polyester resin 10 parts by weight
Ester wax 3 parts by weight
Developer (MA-100) 6 parts by weight
Charge control agent (polysaccharide compound containing Al+Mg) 1 part by weight The above materials are mixed by a Henschel mixer and then melt-kneaded by a twin-screw extruder. The obtained melt-kneaded product is cooled, roughly pulverized with a hammer mill, finely pulverized by a jet pulverizer, and classified to obtain a powder having a volume average diameter of 7 μm. With respect to 100 parts by weight of this powder, the following additives are added and mixed by the Henschel mixer such that the toner is produced. Hydrophobic silica having an average primary particle diameter of 30 nm 1 part by weight Hydrophobic titanium oxide having an average primary particle diameter of 20 nm 0.5 parts by weight The measurement of the softening point of a toner is performed by a temperature raising method using Flow Tester CFT-500 manufactured by Shimadzu Corporation. The temperature is raised at a rate of 2.5° C./min. The point on a curve which corresponds to a descent amount of the plunger by 2 mm on the chart is taken as the softening point.

Toner B1;

The toner B1 is produced in the same manner as the toner A1 except that 85 parts by weight of polyester resin B having softening point 110° C. and 5 parts by weight of the crystalline polyester resin are used.

Toner C1 The toner C1 is produced in the same manner as the toner A1 except that 82 parts by weight of polyester resin C having softening point 113° C. and 8 parts by weight of the crystalline polyester resin are used.

Toner D1;

The toner D1 is produced in the same manner as the toner A except that 75 parts by weight of polyester resin D having softening point 123° C. and 15 parts by weight of the crystalline polyester resin are used, and the toner D2 is obtained by leaving the toner D1 in a 160° C. environment for 24 hours.

Figure 5:
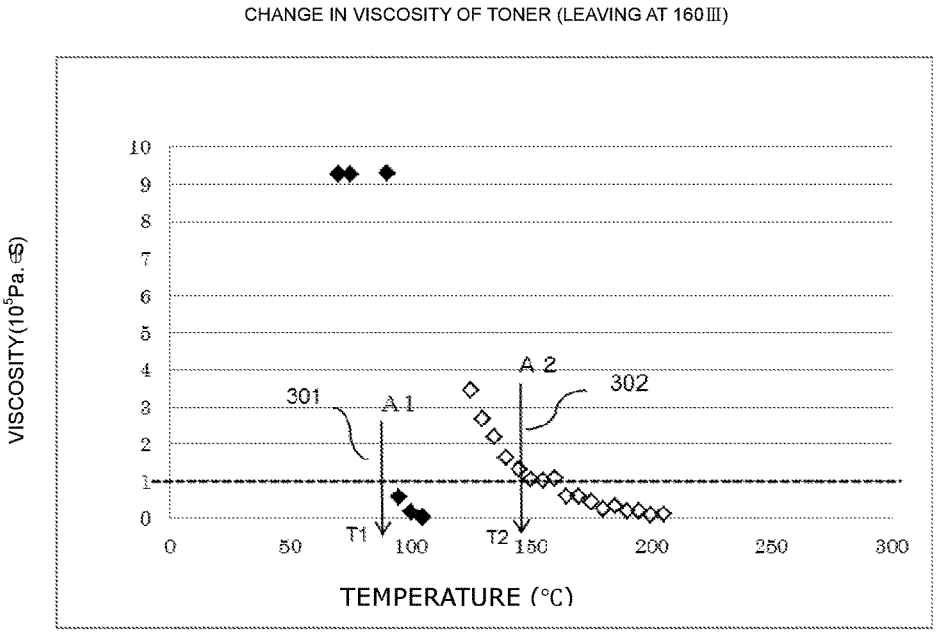
FIG. 5 is a graph illustrating a measured result obtained by measuring viscosity change in accordance with a temperature change with respect to toner A1 and toner A2.

FIG. 5 is a graph illustrating a measured result obtained by measuring a change in viscosity in accordance with temperature change of the toner A1, and the toner A2. The horizontal axis of the graph indicates the heating temperature of the toner. The vertical axis of the graph indicates the viscosity of the toner. The characteristics that the toner is hardened by thermal history can be specified by checking how much the viscosity of each toner differs before and after the thermal history. In the present embodiment, based on a viscosity measured result obtained before and after leaving the toner in the 160° C. environment for 24 hours, the characteristics are indicated by temperature difference in which the viscosity of toner is 1.0 ($10^5$ Pa·s). The viscosity 1.0 ($10^5$ Pa·s) is selected based on the viewpoint of a size that does not scratch the surface of the heat roller 133 by the toner. The viscosity of the toner is measured by using a flow tester CFT 500D manufactured by Shimadzu Corporation under the following conditions.

Heating rate: 2.5° C./min, test load: 10 kg, preheating time: 300 seconds, die hole diameter: 1.0 mm, and die length: 1.0 mm.

The toner A1 is the low melting point toner before leaving the toner in the 160° C. environment for 24 hours. An arrow 301 indicates a temperature T1 at which the viscosity of the toner A becomes 1.0 ($10^5$ Pa·s). According to the arrow 301, the temperature T1 is 90° C. The toner A2 is obtained after leaving the toner A in the 160° C. environment for 24 hours. An arrow 302 indicates a temperature T2 at which the viscosity of the toner A2 becomes 1.0 ($10^5$ Pa·s). According to the arrow 302, temperature T2 is 150° C. Therefore, before and after leaving the low melting point toner, the temperature difference between T1 and T2 is 150° C.−90° C.=60° C.

Figure 6:
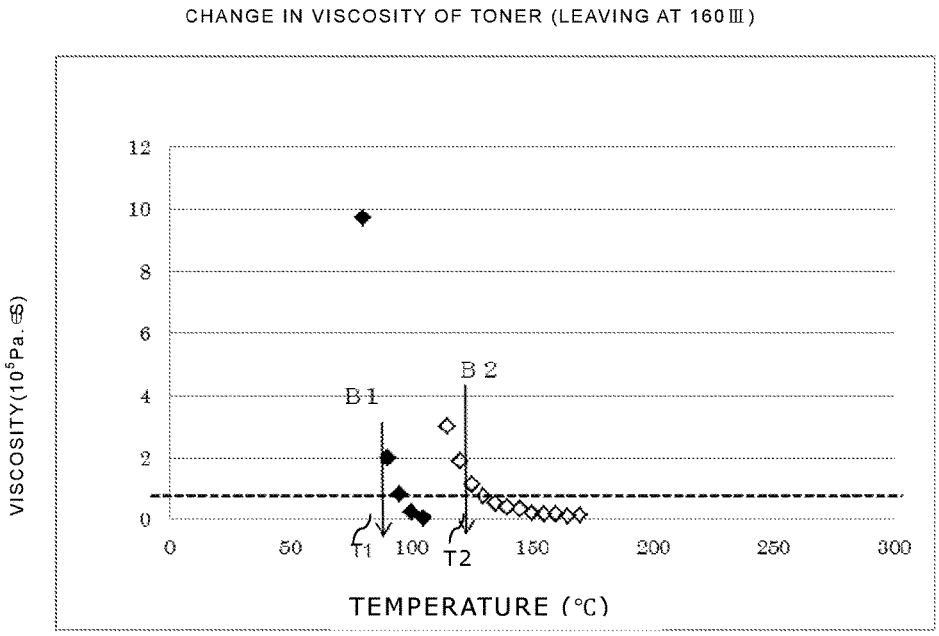
FIG. 6 is a graph illustrating a measured result obtained by measuring viscosity change in accordance with a temperature change with respect to toner B1 and toner B2.

FIG. 6 shows the temperature T1 for toner B1 and the temperature T2 for toner B2. T1 is 90° C. and T2 is 130° C. The temperature difference T1 and T2 is 40° C.

Figure 7:
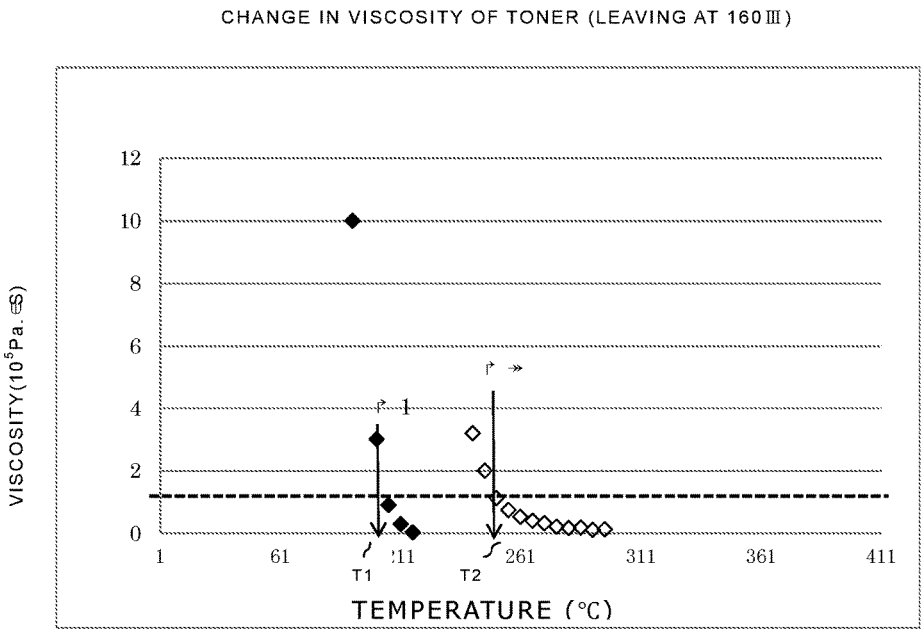
FIG. 7 is a graph illustrating a measured result obtained by measuring viscosity change in accordance with a temperature change with respect to toner C1 and toner C2.

FIG. 7 shows the temperature T1 for toner C1 and the temperature T2 for toner C2. T1 is 90° C. and T2 is 145° C. The temperature difference T1 and T2 is 55° C.

Figure 8:
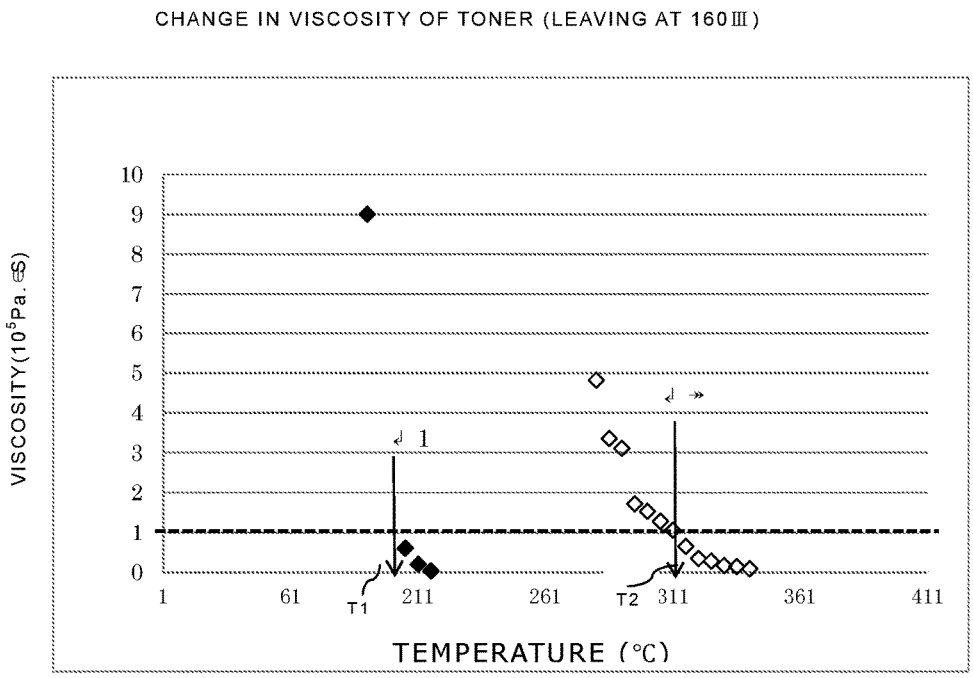
FIG. 8 is a graph illustrating a measured result obtained by measuring viscosity change in accordance with a temperature change with respect to toner D1 and toner D2.

FIG. 8 shows the temperature T1 for toner D1 and the temperature T2 for toner D2. T1 is 90° C. and T2 is 200° C. The temperature difference T1 and T2 is 110° C.

FIG. 9 illustrates a test result when a sheet passing test is performed using the image forming apparatus 100 according to the first embodiment. The sheet passing test is performed under the following conditions. In the sheet passing test, the toner A1 of change in viscosity before and after leaving the toner in the 160° C. environment for 24 hours is 60° C., was used (Example 1 to Example 3 and Comparison example 1 to Comparison example 4). In the sheet passing test, Toshiba MFP e-STUDIO 5008A is used as the image forming apparatus 100. In the sheet passing test, a toner coverage ratio of the image on the sheet was 8%. The toner B1 is used in Example 4 and the toner C1 is used in Example 5.

In the sheet passing test, a recovery time until the temperature of the heat roller 133 reaches the fixing temperature from the standby state is determined based on the following standard. That is, when the recovery time is equal to or less than 10 seconds, it is determined as A. When the recovery time is equal to or less than 20 seconds, it is determined as B. When the recovery time is equal to or greater than 21 seconds, it is determined as C.

In the sheet passing test, a level at which scratches are formed on the heat roller 133 and an image degradation occurs in the image is determined based on the following standard. That is, when the number of passed sheets before the scratches and the image degradation occurs is equal to or greater than 300,000, it is determined as A. When the number of the passed sheets is equal to or greater than 150,000 and less than 300,000, it is determined as B. When the number of the passed sheets is less than 150,000, it is determined as C.

In the sheet passing test, a final evaluation is performed based on a determined result of the recovery time and the number of the passed sheets. In the final evaluation, when any one of the recovery time and the number of the passed sheets is determined as C, the test result is evaluated as C. When none of the recovery time and the number of the passed sheets is determined as C, the test result is evaluated as B.

Example 1 of FIG. 9 illustrates a result obtained by performing the sheet passing test under a condition that a temperature during the standby state was 130° C., which is lower by 30° C. than the fixing temperature of 160° C. when an image is formed. The recovery time from the temperature during the standby state to the fixing temperature was 15 seconds. Accordingly, the recovery time was. In addition, as a result obtained by passing the sheet while checking scratch on the heat roller 133 of the fixing device 130*a* illustrated in FIG. 2, the scratch occurred on the heat roller 133 when the 290,000-th sheet was passed through. Therefore, the scratch on the heat roller was B. Based on a result of the recovery time and the scratch on the heat roller, the final determination was B.

Example 2 of FIG. 9 illustrates a result obtained by performing the sheet passing test under a condition that the temperature during the standby state was 100° C., which is lower, by 60° C. than the fixing temperature. The recovery time from the temperature during the standby state to the fixing temperature was 18 seconds. Accordingly, the recovery time was B. In addition, as a result obtained by passing the sheet while checking the scratch on the heat roller 133 of the fixing device 130*a* illustrated in FIG. 2, the scratch occurred on the heat roller 133 when the 350,000-th sheet was passed through. Therefore, the scratch on the heat roller was A. Based on a result of the recovery time and the scratch on the heat roller, the final determination was B.

Example 3 of FIG. 9 illustrates a result obtained by performing the sheet passing test under a condition that the temperature during the standby state was 150° C., which is lower by 10° C. than the fixing temperature. The recovery time from the temperature during the standby state to the fixing temperature was 10 seconds. Accordingly, the recovery time was A. In addition, as a result obtained by passing the sheet while checking the scratch on the heat roller 133 of the fixing device 130*a* illustrated in FIG. 2, the scratch occurred on the heat roller 133 when the 160,000-th sheet was passed through. Therefore, the scratch on the heat roller was B. Based on a result of the recovery time and the scratch on the heat roller, the final determination was B.

Example 4 of FIG. 9 illustrates a result obtained by performing the sheet passing test under a condition that the temperature during the standby state was 130° C., which is lower by 30° C., than the fixing temperature. The recovery time from the temperature during the standby state to the fixing temperature was 15 seconds. Accordingly, the recovery time was B. In addition, as a result obtained by passing the sheet while checking the scratch on the heat roller 133 of the fixing device 130*a* illustrated in FIG. 2, the scratch occurred on the heat roller 133 when the 400,000-th sheet was passed through. Therefore, the scratch on the heat roller was A. Based on a result of the recovery time and the scratch on the heat roller, the final determination was B.

Example 5 of FIG. 9 illustrates a result obtained by performing the sheet passing test under a condition that the temperature during the standby state was 130° C., which is lower by 30° C. than the fixing temperature. The recovery time from the temperature during the standby state to the fixing temperature was 15 seconds. Accordingly, the recovery time was B. In addition, as a result obtained by passing the sheet while checking the scratch on the heat roller 133 of the fixing device 130*a* illustrated in FIG. 2, the scratch occurred on the heat roller 133 when the 370,000-th sheet was passed through. Therefore, the scratch on the heat roller was A. Based on a result of the recovery time and the scratch on the heat roller, the final determination was B. Comparison example 1 of FIG. 9 illustrates a result obtained by performing the sheet passing test under a condition that the temperature during the standby state was 160° C., which is the same as the fixing temperature. The recovery time from the temperature during the standby state to the fixing temperature was 0 second. Accordingly, the recovery time was A. In addition, as a result obtained by passing the sheet while checking the scratch on the heat roller 133 of the fixing device 130*a* illustrated in FIG. 2, the scratch occurred on the heat roller 133 when the 120,000-th sheet was passed through. Therefore, the heat roller scratch was C. Based on a result of the recovery time and the heat roller scratch, the final determination was C.

Comparison example 2 of FIG. 9 illustrates a result obtained by performing the sheet passing test under a condition that the temperature during the standby state was 152° C., which is lower by 8° C. than the fixing temperature. The recovery time from the temperature during the standby state to the fixing temperature was 6 seconds. Accordingly, the recovery time was A. In addition, as a result obtained by passing the sheet while checking the scratch on the heat roller 133 of the fixing device 130*a* illustrated in FIG. 2, the scratch occurred on the heat roller 133 when the 140,000-th sheet was passed through. Therefore, the heat roller scratch was C. Based on a result of the recovery time and the heat roller scratch, the final determination was C.

Comparison example 3 of FIG. 9 illustrates a result obtained by performing the sheet passing test under a condition that the temperature during the standby state was 98° C., which is lower by 62° C. than the fixing temperature. The recovery time from the temperature during the standby state to the fixing temperature was 22 seconds. Accordingly, the recovery time was C. In addition, as a result obtained by passing the sheet while checking the scratch on the heat roller 133 of the fixing device 130*a* illustrated in FIG. 2, the scratch occurred on the heat roller 133 when the 360,000-th sheet was passed through. Therefore, the heat roller scratch was A. Based on a result of the recovery time and the heat roller scratch, the final determination was C.

Comparison example 4 of FIG. 9 illustrates a result obtained by performing the sheet passing test under a condition that the temperature during the standby state was 80° C., which is lower by 80° C. than the fixing temperature. The recovery time from the temperature during the standby state to the fixing temperature was 25 seconds. Accordingly, the recovery time was C. In addition, as a result obtained by passing the sheet while checking the scratch on the heat roller 133 of the fixing device 130*a* illustrated in FIG. 2, the scratch occurred on the heat roller 133 when the 390,000-th sheet was passed through. Therefore, the heat roller scratch was A. Based on a result of the recovery time and the heat roller scratch, the final determination was C.

Comparison example 5 of FIG. 9 illustrates a result obtained by performing the sheet passing test under a condition that the temperature during the standby state was 130° C., which is lower by 30° C. than the fixing temperature, by using the toner before leaving in the 160° C. environment for 24 hours of the toner D1. The recovery time from the temperature during the standby state to the fixing temperature was 15 seconds. Accordingly, the recovery time was B. In addition, as a result obtained by passing the sheet while checking the scratch on the heat roller 133 of the fixing device 130*a* illustrated in FIG. 2, the scratch occurred on the heat roller 133 when the 100,000-th sheet was passed through. Therefore, the heat roller scratch is was C. Based on a result of the recovery time and the heat roller scratch, the final determination was C.

According to the sheet passing test, by maintaining the temperature of the heat roller during the standby state within a range lower, by −10° C. to −60° C., than the fixing temperature, the low melting point toner deposited on the temperature sensor 131 can reduce thermal influence from the heat roller 133. Thus, it is desirable that the surface temperature of the heat roller 133 during the standby state is maintained within a range lower, by −20° C. to −40° C., than the fixing temperature. The difference between a temperature that causes a viscosity of the toner that is not left under 160° C. for 24 hours to be 1.0 ($10^5$ Pa·s) and a temperature that causes the viscosity of the toner that is left under 160° C. for 24 hours to be 1.0 ($10^5$ Pa·s) is not more than 60° C.

According to the present embodiment, the temperature control unit 152 maintains the temperature of the heat roller during the standby state within a range lower, by −10° C. to −60° C., than the fixing temperature. Accordingly, it is possible to reduce the thermal influence of the low melting point toner deposited on the temperature sensor 131 from the heat roller 133. Therefore, it is possible to reduce the scratch on the heat roller 133 due to hardened toner, and it is possible to form an image with less degradation. Furthermore, since the temperature control unit 152 maintains the temperature of the heat roller during the standby state within a range lower, by −20° C. to −40° C., than the fixing temperature, influence of head on the toner from the heat roller 133 can be further reduced.

Second Embodiment

Figure 10:
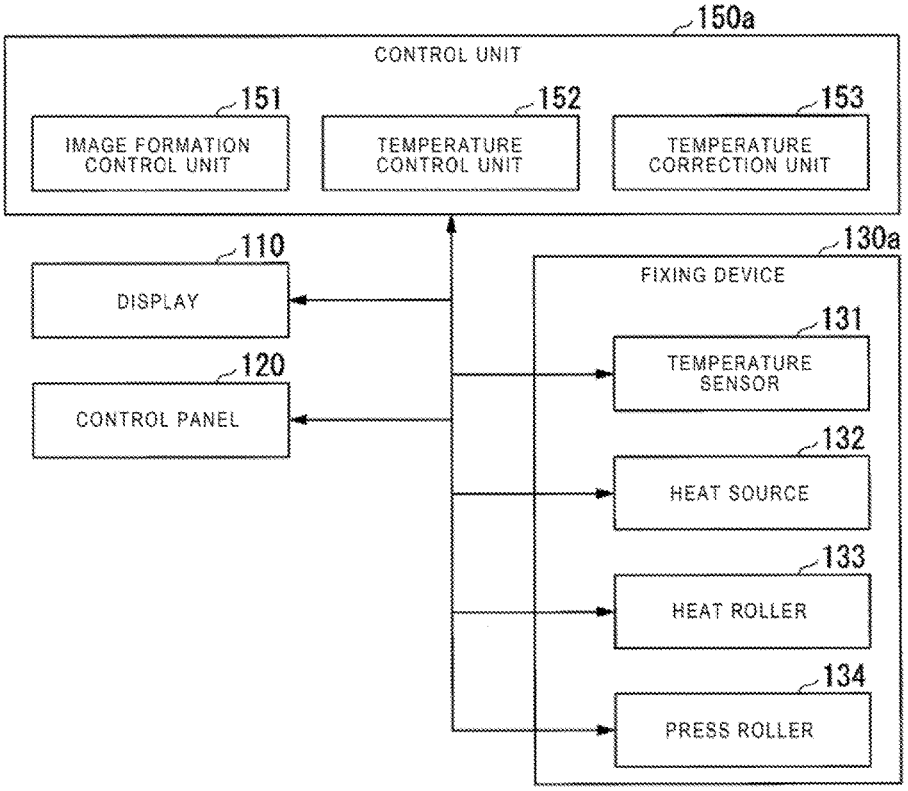
FIG. 10 is a block diagram illustrating functional units for performing a fixing process in an image forming apparatus according to a second embodiment.

Next, the image forming apparatus 100 according to a second embodiment will be described. The toner used in the second embodiment is the above-described toner A. The control manner that the standby temperature is set to be lower than the fixing temperature is the same as the first embodiment. FIG. 10 is a block diagram illustrating functional units for performing a fixing process in the image forming apparatus 100 according to the second embodiment. The image forming apparatus 100 is different from the first embodiment in that a control unit 150*a* is provided instead of the control unit 150, but the rest of the configuration is the same. Hereinafter, differences from the first embodiment will be described.

The control unit 150*a* controls operations of each unit of the image forming apparatus 100. For example, the control unit 150*a* is a device including a CPU and a RAM. The control unit 150*a* executes an image forming program, and thereby functions as the image formation control unit 151, the temperature control unit 152, and a temperature correction unit 153.

The temperature correction unit 153 determines a correction temperature based on a temperature measured by the temperature sensor 131 and warming up time difference. When the toner is attached to the temperature sensor 131, the accuracy of the measured temperature decreases as compared with a state where no toner is attached to the temperature sensor 131. Therefore, a time until the temperature sensor 131 measures the fixing temperature becomes longer than a time when the toner is not attached. The warming up time difference indicates a difference between a time to reach the fixing temperature in a state where no toner is attached and a time to reach the fixing temperature in a state where the toner is attached. The corrected temperature is a temperature determined by correcting the measured temperature when the detection sensitivity of the temperature sensor 131 decreases. The temperature control unit 152 determines the temperature of the heat source 132 based on the corrected temperature.

Figures 11, 12:
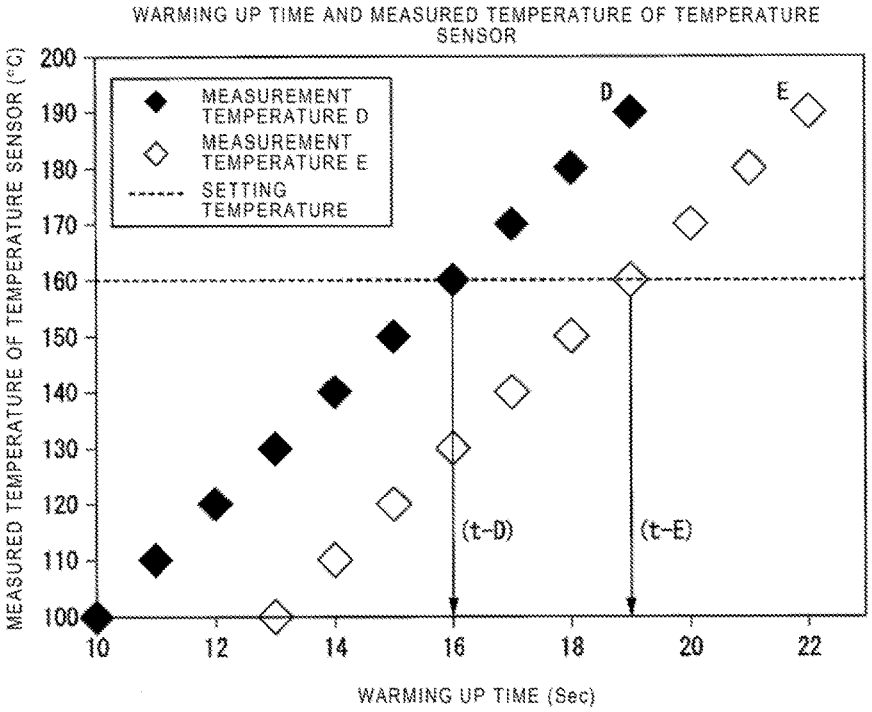
FIG. 11 is a graph illustrating a relationship between a warming up time and a measured temperature of a temperature sensor.
FIG. 12 illustrates one specific example of a heat roller correction temperature for each warming up time difference.

FIG. 11 is a graph illustrating a relationship between a warming up time and a temperature measured by the temperature sensor 131. The horizontal axis of the graph indicates the warming up time. The warming up time indicates a time elapsed from the start of heating the heat roller 133. The vertical axis of the graph indicates a measured temperature of the temperature sensor 131. A measurement temperature D indicates a measured temperature in a reference state in which the toner is not attached to the temperature sensor 131. A measurement temperature E indicates a measured temperature in the reference state in which the toner is attached to the temperature sensor 131. A setting temperature indicates the fixing temperature when an image is formed. According to FIG. 11, the setting temperature is 160° C. In FIG. 11, the measurement temperature D is calculated by the following formula: Temperature D=Temperature E+Constant T.

A time until the measurement temperature D reaches 160° C., which is the setting temperature, is represented as (t-D). (t-D) can be measured in advance before the image forming process is carried out, (e.g., before manufacturing). A time until the measurement temperature E reaches 160° C., which is the setting temperature, is represented as (t-E).

According to FIG. 11, the setting temperature is 160° C. According to FIG. 11, a time (t-D) until the measurement temperature D reaches 160° C. is 16 seconds. According to FIG. 11, a time (t-E) until the measurement temperature E reaches 160° C. is 19 seconds. In a state when the toner is attached to the temperature sensor 131, it can be seen that there is a delay of 3 seconds until the temperature sensor 131 measures 160° C. Therefore, it can be seen that the warming up time difference is 3 seconds.

FIG. 12 illustrates a specific example of a heat roller correction temperature for each warming up time difference. The temperature correction unit 153 determines a correction temperature based on the warming up time difference. For example, when the warming up time difference is 3 seconds, the heat roller correction temperature is −30° C. Therefore, in a state where the toner is attached to the temperature sensor 131, the temperature correction unit 153 sets a temperature obtained by adding 30° C. to the measured temperature of the temperature sensor 131 as the measurement temperature. Different numerical values may be used for the warming up time difference and the heat roller correction temperature of FIG. 12. For example, when the warming up time difference is 2, −5° C. may be used as the heat roller correction temperature.

Figures 13, 14:
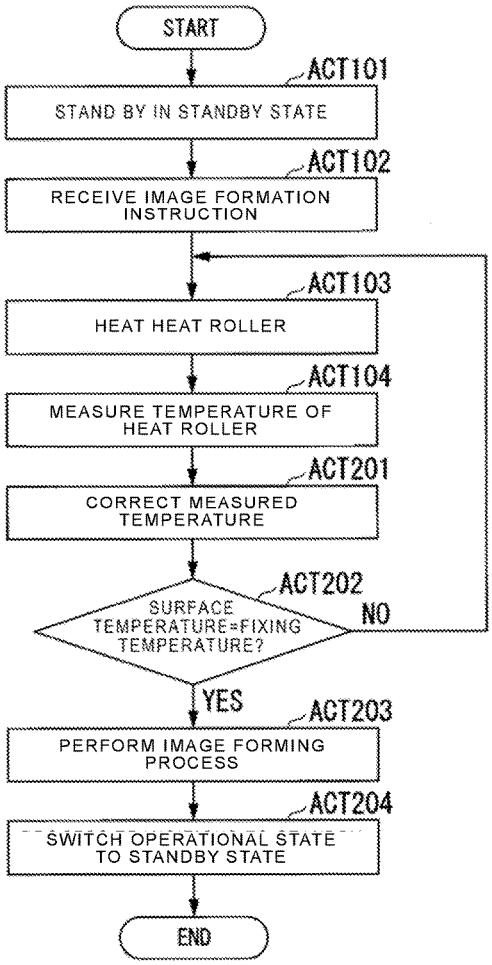
FIG. 13 is a flowchart illustrating a flow of the fixing process carried out by the image forming apparatus according to the second embodiment.
FIG. 14 illustrates a test result obtained by performing a sheet passing test using the image forming apparatus according to the second embodiment.

FIG. 13 is a flowchart illustrating a flow of the fixing process carried out by the image forming apparatus 100 according to the second embodiment. The image forming apparatus 100 stands by during the standby state (Act 101).

The control panel 120 of the image forming apparatus 100 receives the image forming instruction from a user (Act 102). The temperature control unit 152 controls the heat source 132 to generate heat and thereby heats the heat roller 133 (Act 103). The temperature sensor 131 measures the surface temperature of the heat roller 133 (Act 104). The temperature correction unit 153 determines the correction temperature based on the measured surface temperature (Act 201). The temperature control unit 152 determines whether or not the correction temperature and the fixing temperature are equal to each other (Act 202). When the correction temperature and the fixing temperature are not equal to each other (Act 202: NO), the process transitions to Act 103. When the correction temperature and the fixing temperature are equal to each other (Act 202: YES), the printer unit 130 performs the image forming process (Act 203). When the image forming process is finished, the image forming apparatus 100 turns into the standby state (Act 204).

FIG. 14 illustrates a test result when the sheet passing test is performed using the image forming apparatus 100 according to the second embodiment. The sheet passing test is performed under the same condition as the condition of the first embodiment.

Example 4 of FIG. 14 illustrates a result obtained by performing the sheet passing test at −10° C. of the heat roller correction temperature when the warming up time difference was 1. As a result obtained by passing the sheet while checking the scratch on the heat roller 133 of the fixing device 130*a* illustrated in FIG. 2, the scratch occurred on the heat roller 133 when the 260,000-th sheet was passed through. Therefore, the heat roller scratch was B. The final determination was B.

Example 5 of FIG. 14 illustrates a result obtained by performing the sheet passing test at −20° C. of the heat roller correction temperature when the warming up time difference was 2. As the result obtained by passing the sheet while checking the scratch on the heat roller 133 of the fixing device 130*a* illustrated in FIG. 2, the scratch occurred on the heat roller 133 when the 280,000-th sheet was passed through. Therefore, the heat roller scratch was B. The final determination was B.

According to the present embodiment, the temperature correction unit 153 can measure a suitable surface temperature of the heat roller by applying correction on the measured temperature. Therefore, the influence of heat from the heat roller 133 on the toner deposited on the temperature sensor 131 can be reduced. Furthermore, the image forming apparatus 100 can reduce the recovery time from the standby state. Therefore, it is possible to reduce the scratches on the heat roller 133 due to the hardened toner, and it is possible to form an image with less degradation. Furthermore, it is possible to reduce a user's standby time associated with the image forming process.

According to at least one embodiment described above, by providing the temperature control unit 152, it is possible to form an image with less degradation.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A method for forming a fixed toner image on a sheet using an image forming apparatus, comprising:

maintaining a temperature of a fixing device of the image forming apparatus at a standby temperature during a standby state;

after wake-up from the standby state, forming an unfixed toner image on a sheet using a toner, wherein a difference between a temperature to cause a viscosity of the toner in a first condition to be 1.0 ($10^5$ Pa·s) and a temperature to cause the viscosity of the toner in a second condition to be 1.0 ($10^5$ Pa·s) is within a range of 30° C. to 60° C., the toner in the first condition not having been maintained in a 160° C. environment for 24 hours and the toner in the second condition having been maintained in a 160° C. environment for 24 hours;

after forming the unfixed toner image on the sheet, increasing the temperature of the fixing device to a fixing temperature of the toner, which is higher than the standby temperature by 10° C. to 60° C.; and after the temperature of the fixing device has reached the fixing temperature, passing the sheet with the unfixed toner image through the fixing device such that the unfixed toner image is fixed onto the sheet.

2. The method according to claim 1, wherein the temperature of the fixing device during the standby state is lower than the fixing temperature by 20° C. to 40° C.

3. The method according to claim 1, wherein the fixing temperature of the toner is no greater than 160° C.

4. The method according to claim 1, wherein said forming the unfixed toner image is carried out after the temperature of the fixing device has reached the fixing temperature.

5. The method according to claim 1, wherein the toner contains crystalline polyester.

6. The method according to claim 1, wherein the fixing device includes a heat roller and a press roller between which the sheet is passed.

7. The method according to claim 6, further comprising:

measuring a temperature of the surface of the heat roller using a temperature sensor, wherein the temperature of the fixing device is the measured temperature.

8. The method according to claim 7, wherein the temperature sensor comprises a contact-type thermistor that is in contact with the surface of the heat roller.

9. The method according to claim 6, further comprising:

measuring a temperature of the surface of the heat roller using a temperature sensor; and correcting the measured temperature based on an amount of time that was required for the measured temperature to reach a predetermined temperature, wherein the temperature of the fixing device is the corrected temperature.

10. The method according to claim 9, wherein the temperature sensor comprises a contact-type thermistor that is in contact with the surface of the heat roller.

11. An image forming apparatus comprising:

a printer configured to form an image on a sheet using a toner;

a fixing device configured to heat and fix the toner on the sheet;

a temperature sensor configured to measure a surface temperature of the fixing device; and a control unit configured to detect a type of the toner, and upon detecting that the type of the toner is one in which difference in heating temperature is within a range of 30° C. to 60° C. when viscosity is 1.0 ($10^5$ Pa·s)

before and after leaving the toner under 160° C. for 24 hours, control the surface temperature of the fixing device and a standby temperature of the fixing device to a temperature lower, by 10° C. to 60° C., than a fixing temperature of the toner.

12. The image forming apparatus according to claim 11, wherein the temperature of the fixing device during the standby state is lower than the fixing temperature by 20° C. to 40° C.

13. The image forming apparatus according to claim 11, wherein the fixing temperature of the toner is no greater than 160° C.

14. The image forming apparatus according to claim 11, wherein the fixing device fixes the toner on the sheet after the temperature of the fixing device has reached the fixing temperature.

15. The image forming apparatus according to claim 11, wherein the toner contains crystalline polyester.

16. The image forming apparatus according to claim 11, wherein the fixing device includes a heat roller and a press roller between which the sheet is passed.

17. The image forming apparatus according to claim 16, further comprising:

a temperature sensor that measures a temperature of the surface of the heat roller as the temperature of the fixing device.

18. The image forming apparatus according to claim 17, wherein the temperature sensor comprises a contact-type thermistor that is in contact with the surface of the heat roller.

19. The image forming apparatus according to claim 16, further comprising:

a temperature sensor that measures a temperature of the surface of the heat roller as the temperature of the fixing device, wherein the control unit is configured to correct the measured temperature based on an amount of time that was required for the measured temperature to reach a predetermined temperature, wherein the temperature of the fixing device is the corrected temperature.

20. The image forming apparatus according to claim 19, wherein the temperature sensor comprises a contact-type thermistor that is in contact with the surface of the heat roller.

* * * * *